US012686045B2

(12) United States Patent
Nagahashi

(10) Patent No.: US 12,686,045 B2
(45) Date of Patent: Jul. 21, 2026

(54) BENDING METHOD AND BENDING SYSTEM

(71) Applicant: AMADA CO., LTD., Kanagawa (JP)

(72) Inventor: Hirohito Nagahashi, Kanagawa (JP)

(73) Assignee: AMADA CO., LTD., Kanagawa (JP)

( * ) Notice: Subject to any disclaimer, the term of this patent is extended or adjusted under 35 U.S.C. 154(b) by 362 days.

(21) Appl. No.: 18/280,928

(22) PCT Filed: Feb. 18, 2022

(86) PCT No.: PCT/JP2022/006536
§ 371 (c)(1),
(2) Date: Sep. 7, 2023

(87) PCT Pub. No.: WO2022/196240
PCT Pub. Date: Sep. 22, 2022

(65) Prior Publication Data

US 2024/0293857 A1 Sep. 5, 2024

(30) Foreign Application Priority Data

Mar. 16, 2021 (JP) ..... 2021-042531

(51) Int. Cl.
*B21D 5/02* (2006.01)

(52) U.S. Cl.
CPC ..... *B21D 5/02* (2013.01)

(58) Field of Classification Search
CPC ..... B21D 5/004; B21D 5/02; G05B 19/19; G05B 19/41825; G05B 2219/36203; G05B 2219/40054; G05B 2219/45143
See application file for complete search history.

(56) References Cited

U.S. PATENT DOCUMENTS 4,805,439 A * 2/1989 Kobayashi ..... B21D 5/02 72/701
2006/0032283 A1* 2/2006 Thomae ..... B21D 28/00 72/20.1

(Continued)

FOREIGN PATENT DOCUMENTS

JP H04-59126 A 2/1992
JP H04-59128 A 2/1992

(Continued)

OTHER PUBLICATIONS

Extended European Search Report for corresponding EP Application No. 22770999.5 dated Jun. 25, 2024.

(Continued)

*Primary Examiner* — Vincent H Tran
(74) *Attorney, Agent, or Firm* — Renner, Otto, Boisselle & Sklar, LLP

(57) ABSTRACT

A bending method includes acquiring a reference value of an original position of a punch with respect to a die for each processed part before an operation of bending of a workpiece by a bending machine including the punch and the die is started, storing each of the acquired reference values in association with each of the processed parts, reading the reference value associated with the processed part to which the bending is to be executed, acquiring a measurement value of the original position after the operation of the bending of the workpiece is started, calculating, based on the acquired measurement value, a secular change amount from the reference value or a previous measurement value as a secular change correction value for a pushing amount of the punch with respect to the die or the original position of the punch, and resetting, for each predetermined trigger condition, the pushing amount or the original position by using the (Continued)

secular change correction value during an automatic operation of the bending of the workpiece.

20 Claims, 7 Drawing Sheets

(56) References Cited

U.S. PATENT DOCUMENTS

| | | | | |
|---|---|---|---|---|
| 2007/0295909 | A1* | 12/2007 | Garland | B21D 55/00 72/3 |
| 2013/0340494 | A1* | 12/2013 | Frigo | B21D 5/045 72/17.3 |
| 2022/0288663 | A1* | 9/2022 | Nagahashi | B21D 5/02 |

FOREIGN PATENT DOCUMENTS

| | | | | |
|---|---|---|---|---|
| JP | 2006-88183 | A | 4/2006 | |
| JP | 2019-10666 | A | 1/2019 | |
| WO | WO-2008119090 | A1 * | 10/2008 | B21D 5/006 |

OTHER PUBLICATIONS

International Search Report for corresponding Application No. PCT/JP2022/006536, mailed May 10, 2022.
Written Opinion for corresponding Application No. PCT/JP2022/006536, mailed May 10, 2022.

* cited by examiner

8

| 8a PRODUCT | 8b USED TOOL | 8c REFERENCE VALUE OF ORIGIN POINT | 8d MEASUREMENT VALUE | 8e CORRECTION VALUE |
|---|---|---|---|---|
| PROCESSED PART A | TOOL a, TOOL b, TOOL c | UTA(UTa、UTb、UTc) | UTA' | ΔUTA |
| PROCESSED PART B | TOOL b, TOOL d, TOOL e | UTB(UTb、UTd、UTe) | UTB' | ΔUTB |
| ⋮ | ⋮ | ⋮ | ⋮ | ⋮ |

BENDING METHOD AND BENDING SYSTEM

TECHNICAL FIELD

The present invention relates to a bending method and a bending system.

BACKGROUND ART

There is known a bending machine in which an approximation expression of a bending load is obtained based on an initial bending load and a relative moving position of a punch with respect to a die when a workpiece is bent by the bending machine (see Patent Literature 1). In this bending machine, a change in a bending angle due to displacement of a frame associated with a secular change of the bending machine is corrected by obtaining the approximate expression every time the bending is performed, for every predetermined number of times of the bending, for every arbitrary number of times of the bending, or the like.

CITATION LIST

Patent Literature

Patent Literature 1: Japanese Patent Laid-Open No. 2006-88183

SUMMARY

Technical Problem

However, in the bending machine disclosed in Patent Literature 1 described above, even when a plurality of different types of processed parts are continuously bent by a long-time operation, for example, it is necessary for an operator to periodically confirm an accuracy of the bending after the processed part is changed or the like, in addition to stopping the machine operation every time the correction is to be made. Therefore, there is a limit to stabilizing quality of the processed part while reducing a burden of the accuracy confirmation work.

One aspect of the present invention is a bending method and a bending system capable of stabilizing quality of a processed part while reducing a burden of an accuracy confirmation work performed by an operator.

Solution to Problem

A bending method according to one aspect of the present invention includes acquiring a reference value of an original position of a punch with respect to a die for each processed part before an operation of bending of a workpiece by a bending machine including the punch and the die is started, storing each of the acquired reference values in association with each of the processed parts, reading the reference value associated with the processed part to which the bending is to be executed, acquiring a measurement value of the original position after the operation of the bending of the workpiece is started, calculating, based on the acquired measurement value, a secular change amount from the reference value or a previous measurement value as a secular change correction value for a pushing amount of the punch with respect to the die or the original position of the punch, and resetting, for each predetermined trigger condition, the pushing amount or the original position by using the secular change correction value during an automatic operation of the bending of the workpiece.

According to the bending method related to the one aspect of the present invention, the reference value of the original position of the punch with respect to the die for each processed part is acquired before the operation of the bending of the workpiece by the bending machine is started, and each of these reference values is stored in association with each of the processed parts. Then, the reference value associated with the processed part to which the bending is to be executed is read. After the operation of the bending is started, the measurement value of the original position is acquired so as calculate the secular change amount from the reference value or the previous measurement value based on the measurement value as the secular change correction value for the pushing amount of the punch with respect to the die or the original position of the punch. By using this secular change correction value, the pushing amount or the original position is reset for each predetermined trigger condition during the automatic operation of the bending. Therefore, quality of the processed part is stabilized while the burden of the accuracy confirmation work performed by the operator is reduced.

Advantageous Effects of Invention

According to one aspect of the present invention, it is possible to stabilize quality of a processed part while reducing a burden of an accuracy confirmation work performed by an operator.

DESCRIPTION OF EMBODIMENTS

Hereinafter, a bending method and a bending system according to the embodiments of the present invention will be described in detail with reference to the attached drawings. However, the following embodiments do not limit the invention according to each claim, and not all combinations of features described in the embodiments are essential for the solution of the invention. Further, in the following embodiments, the scale and dimensions of each component may be exaggerated, and some components may be omitted.

First Embodiment

Figure 1:
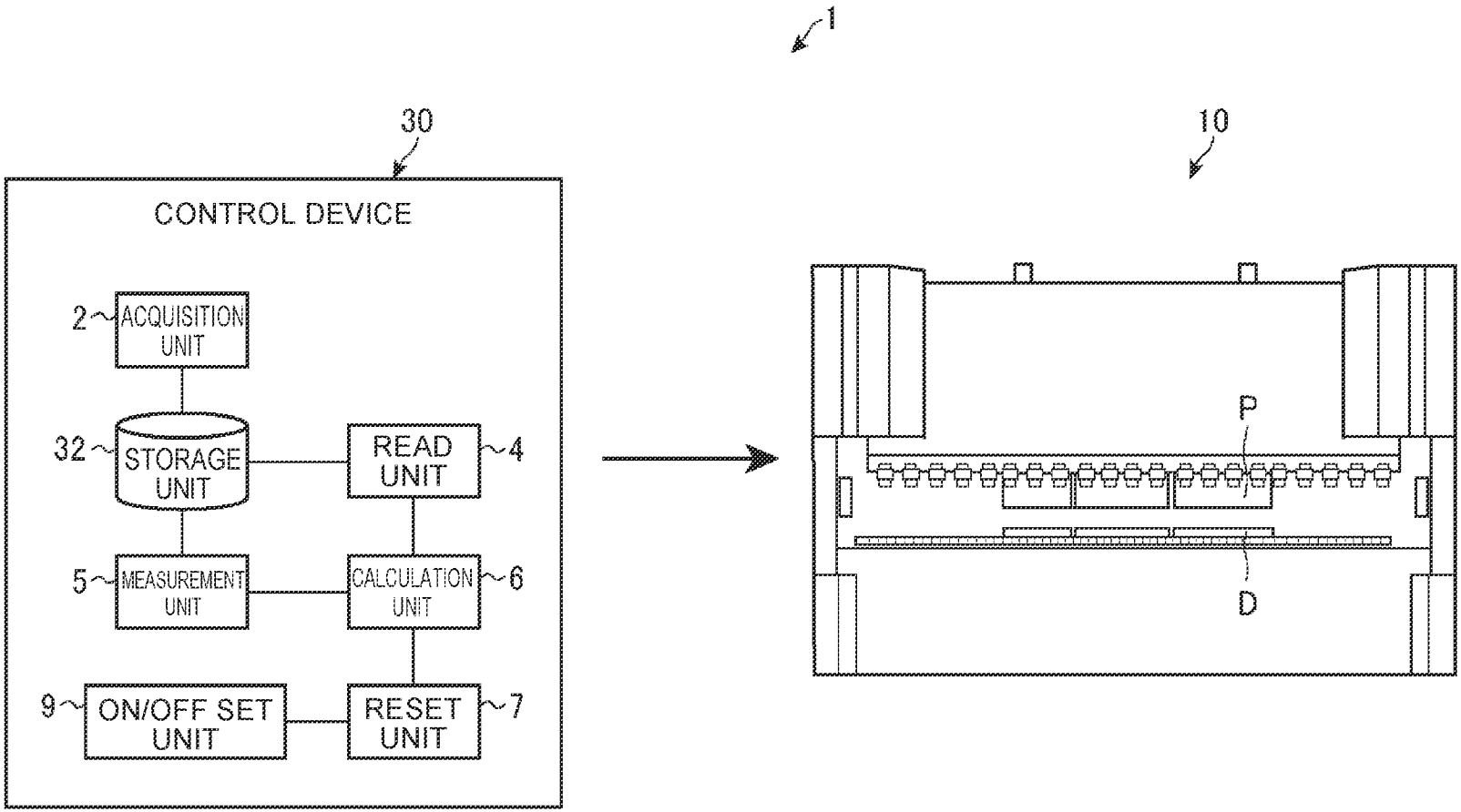
FIG. 1 is an explanatory diagram showing a basic configuration of a bending system that executes a bending method according to a first embodiment of the present invention.
Figure 2:
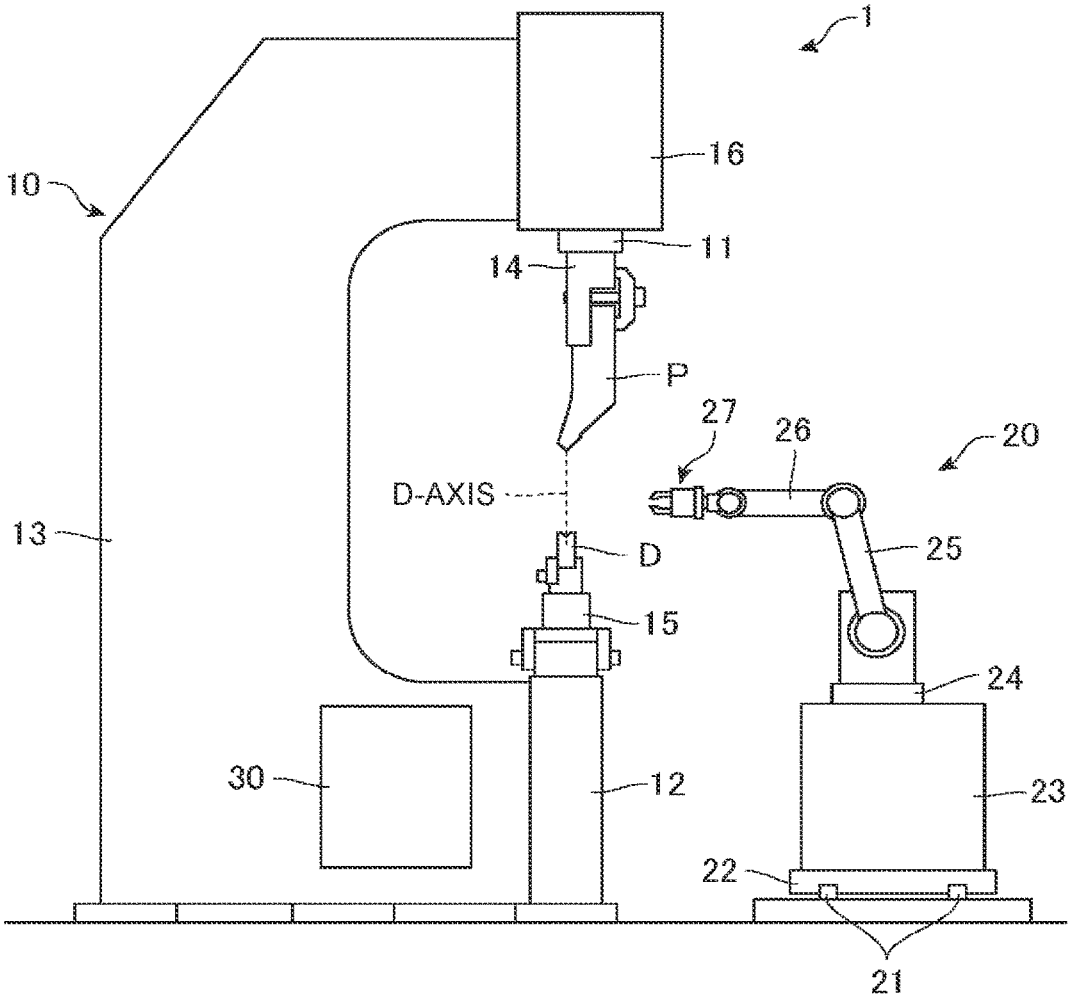
FIG. 2 is an explanatory diagram showing a schematic entire configuration of the bending system.
Figure 3:
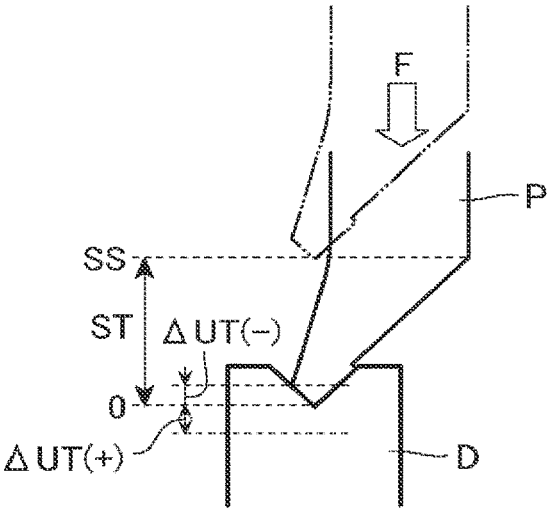
FIG. 3 is an explanatory diagram showing an outline of a typical tool used for a bending machine of the bending system.
Figures 4, 5:
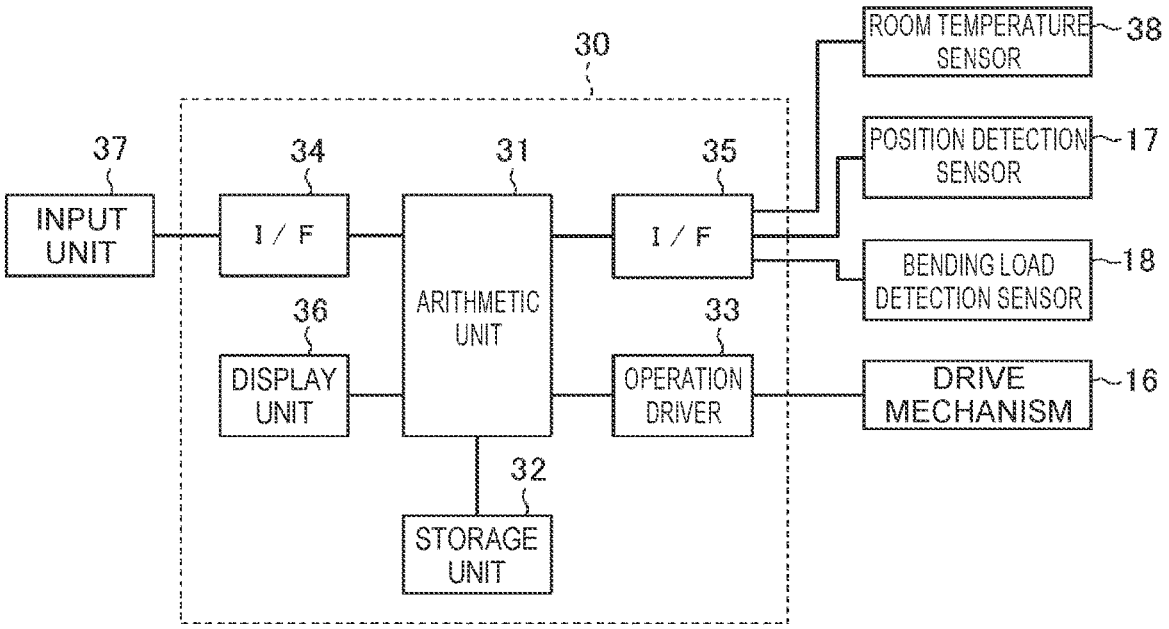
FIG. 4 is a block diagram showing a schematic internal configuration of a control device of the bending system.
FIG. 5 is a diagram for explaining an association table of processed parts and reference values, which is stored in a storage unit of the control device.

FIG. 1 is an explanatory diagram showing a basic configuration of a bending system that executes a bending method according to a first embodiment of the present invention. FIG. 2 is an explanatory diagram showing a schematic entire configuration of the bending system. FIG. 3 is an explanatory diagram showing an outline of a typical tool used for a bending machine of the bending system. FIG. 4 is a block diagram showing a schematic internal configuration of a control device of the bending system.

As shown in FIG. 1, a bending system 1 according to the first embodiment includes a bending machine 10 including a punch P and a die D, and a control device 30 configured to control the bending machine 10 to perform bending. The control device 30 includes an acquisition unit 2 configured to acquire a reference value of an original position of the punch P with respect to the die D for each processed part before an operation of the bending of a workpiece by the bending machine 10 is started, a storage unit 32 configured to store each of the acquired reference values in association with each of the processed parts, a read unit 4 configured to read the reference value associated with the processed part to which the bending is to be executed, a measurement unit 5 configured to acquire a measurement value of the original position after the operation of the bending of the workpiece is started, a calculation unit 6 configured to calculate, based on the acquired measurement value, a secular change amount from the reference value or a previous measurement value as a secular change correction value for a pushing amount of the punch P with respect to the die D or as of the original position of the punch P, and a reset unit 7 configured to reset, for each predetermined trigger condition, the pushing amount or the original position by using the secular change correction value during an automatic operation of the bending of the workpiece. It should be noted that, in the first embodiment, the control device 30 includes an ON/OFF set unit 9 configured to set ON/OFF of an execution of resetting in the reset unit 7, for example. It should be noted that the reference value is acquired for each processed part obtained by bending the workpiece, and is obtained when the punch P and the die D are brought into engagement with each other such that a pressure reaches a predetermined pressure.

More specifically, as shown in FIG. 2, the bending system 1 includes an automatic robot 20 that is a manipulator configured to position the workpiece with respect the tools, which are the punch P and the die D, of the bending machine 10 such as a press brake, but the bending system 1 is not limited to this. In a configuration including the automatic robot 20, the control device 30 controls the bending machine 10 and the automatic robot 20 to execute the bending of the workpiece.

It should be noted that the control device 30 is composed of a general-purpose NC (numerical control) device, a work station, a personal computer, or the like, and is configured to be capable of communicating data to the bending machine 10 that actually bends the workpiece. Since the basic structures of the bending machine 10 and the automatic robot 20 are known, only the outlines thereof will be described here. Further, in the following descriptions, the "X-axis direction" means the left-right direction when the front of the bending machine 10 is faced, the "Y-axis direction" means the depth direction in that case, and the "Z-axis direction" means the vertical direction in that case.

First, the bending machine 10 of the bending system 1 will be described. As shown in FIG. 2, the bending machine 10 includes an upper table 11 and a lower table 12 in the center of the front surface. The upper table 11 and the lower table 12 are arranged in line vertically (in the Z-axis direction) such that each of surfaces on one side in the depth direction (in the Y-axis direction), for example, each of plate surfaces on the outside faces the front surface. Further, the bending machine 10 includes support units 13 that support the upper table 11 and the lower table 12 and are arranged on the left and right, respectively.

Furthermore, the bending machine 10 includes a drive mechanism 16. The drive mechanism 16 is configured to, for example, reciprocate the upper table 11 vertically with respect to the lower table 12. Additionally, the bending machine 10 includes a position detection sensor 17 (see FIG. 4) configured to detect a moving position when the upper table 11 is moved by the drive mechanism 16.

Here, the upper table 11 and the lower table 12 are made of a plate-shaped member such as a metal, for example. The upper table 11 includes a plurality of upper tool holders 14 each holding an upper tool such as the punch P at the lower portion thereof. The lower table 12 includes lower tool holders 15 each holding a lower tool such as the die D at the upper portion thereof. In the present embodiment, each support units 13 is composed of a plate-shaped side frame formed in a substantially channel shape in a lateral view, for example, but the support unit 13 is not limited to this. Each support unit 13 may be composed of, for example, a rod-shaped tie bar or the like.

The drive mechanism 16 is, for example, a hydraulic cylinder that serves as a drive source for the upper table 11. The drive mechanism 16 is attached to the upper part of each of the support units 13. Each of the drive mechanisms 16 is configured to relatively reciprocate (move up and down) the upper table 11 vertically with respect to the lower table 12. It should be noted that each of the drive mechanisms 16 can use another drive means such as a servo motor, in place of the hydraulic cylinder.

As shown in FIG. 4, the position detection sensor 17 detects a relative moving position of the punch P with respect to the die D when the upper table 11 is moved by the drive mechanism 16. Since the position detection sensor 17 is composed of, for example, an encoder, a linear scale, or the like, and thus is publicly known, detailed description thereof will be omitted here.

The position detection sensor 17 can detect a pushing amount (a moving stroke amount) (mm) that represents an inter-blade distance on a D-axis of the tools by the punch P and the die D. The inter-blade distance means, for example, a distance between the distal end (the lower end) of the punch P and the upper surface (the opening side end) of the die D, or a distance between the distal end of the punch P and the bottom end of the die D, and the like, and may be defined as a D value.

In the present embodiment, the pushing amount is defined as follows. That is, as shown in FIG. 3, the position at which the punch P and the die D are engaged with each other without the workpiece is defined as a tool reference position (0 mm), for example. Then, the position of the distal end (the lower end) of the punch P at a predetermined position in the direction in which the punch P is separated from the reference position is defined as a Stroke Start (SS) position. The pushing amount represents a distance from the reference position to the SS position (so-called the inter-blade distance) in this case. It should be noted that the tool used has a total length of, for example, 35 mm or more in the left-right direction. This is because if the total length is less than 35 mm, the tool may not be able to withstand a predetermined load that will be described later when the predetermined load is applied.

It should be noted that although the details thereof will be described later, in the first embodiment, the reference value and the measurement value are acquired based on the D-axis position when the predetermined load is applied to the punch P and the die D. That is, the value of the D-axis when a predetermined load F (for example, 10 kN≅1000 kgf) is applied at this reference position by the control device 30 is read as a reference value (UT0) of the original position of the punch P or a measurement value (UT1 to UTn).

Then, based on these values that are read, the secular change amount of an entire mechanical system including the tool, the drive mechanism 16, and the like is calculated as a secular change correction value (AUT). The secular change correction value (AUT) calculated in this manner is used as the correction value for the pushing amount of the punch P. For example, the pushing amount is corrected by adding this correction value to the pushing amount. It should be noted that as will be described later, the reference value (UT0) includes reference values (UTa, UTb, and the like) associated with the tools to be used for the bending of the processed parts.

The bending machine 10 further includes a bending load detection sensor 18 (see FIG. 4) for detecting a bending load applied to the punch P when the upper table 11 is moved by the drive mechanism 16 so that the punch P and the die D are engaged with each other to bend the workpiece. The bending load detection sensor 18 can be configured to detect a fluid pressure when the drive mechanism 16 is composed of, for example, the hydraulic cylinder as described above.

Furthermore, the bending load detection sensor 18 can be configured to detect a torque and a load current when the drive mechanism 16 is composed of a motor. In addition, as the bending load detection sensor 18, various configurations can be adopted such as a piezoelectric element arranged on a mounting portion of the punch P with respect to the upper table 11 (or a mounting portion of the die D with respect to the lower table 12).

Next, the automatic robot 20 of the bending system 1 will be described.

The automatic robot 20 includes, for example, a slider 22 that can move in the left-right direction along a guide rail 21 extending in the left-right direction (the X-axis direction). The automatic robot 20 includes a base frame 23 placed on the slider 22.

Further, the automatic robot 20 includes a rotating base 24 that is arranged on the base frame 23 and can turn in the horizontal direction. The rotation base 24 is provided with a first arm 25, which can swing (rotate) up and down, around a horizontally extending rotation shaft. Further, a second arm 26 rotatably arranged around a horizontally extending rotation shaft is provided on the distal-end side of the first arm 25.

Further, a robot hand 27, which is rotatable around a horizontally extending rotating shaft and rotatable around a rotating shaft in the direction orthogonal to the longitudinal direction of the second arm 26, is provided on the distal-end side of the second arm 26. The automatic robot 20 carries in and supplies the workpiece for the bending machine 10 between the punch P and the die D (that is, between the tools) during the automatic operation of the bending of the workpiece. Along with this, the automatic robot 20 discharges and carries out the bent workpiece (the processed part) from the bending machine 10.

In the bending system 1 of the present embodiment, by causing the bending machine 10 and the automatic robot 20 to cooperate with each other under the control of the control device 30, for example, bending of different types of products (processed parts) can be performed by the automatic operation (relay operation). It should be noted that here, the relay operation refers to an operation in which different processed parts are continuously bent in the automatic operation of a series of the bending processes.

Next, the control device 30 of the bending system 1 will be described.

As shown in FIG. 4, the control device 30 includes, for example, an arithmetic unit 31, a storage unit 32, an operation driver 33, an input interface (I/F) 34, a communication interface (I/F) 35, and a display unit 36. The arithmetic unit 31 includes, for example, a CPU (central processing unit), and together with the input I/F 34 and the communication I/F 35 described above, achieves functions of the acquisition unit 2, the read unit 4, the measurement unit 5, the calculation unit 6, the reset unit 7, and the ON/OFF set unit 9.

The storage unit 32 includes storage media such as a RAM (random access memory), a ROM (read only memory), an HDD (hard disk drive), and an SSD (solid state drive) so as to stores various pieces of data in a readable and writable manner. The operation driver 33 causes the drive mechanism 16 to operate in accordance with an operation command from the arithmetic unit 31. The input I/F 34 is connected to an input unit 37 composed of input devices such as a keyboard, a mouse, and a touch panel so as to input, to the arithmetic unit 31, input information from the input unit 37.

A room temperature sensor 38, which is composed of a thermocouple and the like, for measuring a room temperature in an environment in which the bending machine 10 is installed is electrically connected to the communication I/F 35, together with the position detection sensor 17 and the bending load detection sensor 18 described above. The display unit 36 may be configured by a display, a monitor, a touch panel having a function of the input unit 37, and the like.

For example, a UI screen (not shown) for controlling the bending machine 10 is displayed on a display screen of the display unit 36. On this UI screen, for example, various types of information such as processing conditions, information indicating the secular change correction value (AUT) used for the bending, and the like are displayed in such a manner that allows for visual recognition and setting operation. Since the configurations of the respective units of the control device 30 are publicly known, detailed descriptions thereof will be omitted here.

In the control device 30, a bending program stored in the storage unit 32 is called and executed by the arithmetic unit 31. The arithmetic unit 31 controls an operation of the drive mechanism 16 of the bending machine 10 and an operation of the automatic robot 20 via the operation driver 33 under the control of this program.

It should be noted that the arithmetic unit 31 executes various types of arithmetic processing relating to the bending based on the processing conditions such as a thickness, a material, a bending angle, and tool conditions of the workpiece that are input via the input unit 37 and the input I/F 34, and based on detected information from the respective sensors 17, 18, 38 that is obtained through the communication I/F 35. In the arithmetic processing, the arithmetic unit 31 also performs arithmetic calculations of the pushing amount of the punch P from the SS position to the reference position with respect to the die D, a contact position at which the punch P is brought into contact with the workpiece, a relative pushing amount from the contact position for bending the workpiece to a desired bending angle, and the like.

The control device 30 of the bending system 1 of the present embodiment can execute resetting of resetting the pushing amount described above for each predetermined trigger condition during the automatic operation of the bending of the workpiece by the bending machine 10. More specifically, before the operation of the bending is started, a check operation including trial processing and precision imparting of the mechanical system is performed for each product (processed part), and the reference value of the original position described above is acquired by the acquisition unit 2. Then, the storage unit 32 associates each of the acquired reference values with each of the processed parts, and creates an association table 8 (see FIG. 5) in a database (DB) in the storage unit 32, for example, for storage.

Here, the association table 8 will be explained.

FIG. 5 is a diagram for explaining the association table of the processed parts and the reference values, which is stored in the storage unit of the control device.

As shown in FIG. 5, the association table 8 includes a product column 8*a*, a used tool column 8*b*, an original position reference value column 8*c*, a measurement value column 8*d*, and a correction value column 8*e*.

Information on the processed part, which is obtained by bending the workpiece, such as "a processed part A, a processed part B, or the like" is stored in the product column 8*a*. Information on the tools used for the bending of each of the processed parts in the product column 8*a* is stored in the used tool column 8*b* in association with each of the processed parts. Therefore, for example, tools (used tools) used for "the processed part A" are associated with "a tool a, a tool b, a tool c", and used tools for "the processed part B" are associated with "the tool b, a tool d, and a tool e".

Information on the reference value for each of the processed parts, which is acquired by the acquisition unit 2, is stored in the original position reference value column 8*c* in association with each of the processed parts. For example, the reference value "UTA (UTa, UTb, UTc)" is associated to "the processed part A", and the reference value "UTB (UTb, UTd, UTe) is associated to "the processed part B".

It should be noted that "(UTa, UTb, UTC)" in the reference value "UTA" and "(UTb, UTd, UTe)" in the reference value "UTB" represent the reference values that are specific to the tools associated with the used tools, respectively. The reference value stored in the original position reference value column 8*c* can be reset, for example, by an operation input or the like of an operator. When the reference value is reset, the reference value can be acquired and stored again by the control device 30 before an operation of the next bending is started.

The measurement value acquired by the measurement unit 5 is stored in the measurement value column 8*d* in association with each of the processed parts. For example, the measurement value of "the processed part A" is associated with "UTA'", and the measurement value of "the processed part B" is associated with "UTB'". These measurement values stored in the measurement value column 8*d* may be stored, for example, such that a previous measurement value and a current measurement value coexist. Alternatively, the measurement values may be stored such that the previous measurement value is overwritten by the current measurement value.

In the correction value column 8*e*, the correction value for the secular change amount (the secular change correction value), which is calculated by the calculation unit 6 based on the reference value of the reference value column 8*c* read by the read unit 4 and based on the measurement value of the measurement value column 8*d* acquired by the measurement unit 5 (or the previous measurement value stored in advance in the measurement value column 8*d*), is stored for each of the processed parts. Specifically, a correction value for "the processed part A" is stored as "AUTA", and a correction value for "the processed part B" is stored as "AUTB".

Since the reference value (and the measurement value and the correction value) are associated for each of the processed parts by the association table 8 configured in this manner and stored in the storage unit 32, an operation in which the correction value is reflected is possible even from the first bending. In addition, the operation can be performed without the operator having to perform an accuracy confirmation work even when the processed part is changed or the tool is changed.

Further, since the reference value for each of the processed parts (and for each of the tools) is stored in the association table 8 and stored in the storage unit 32, it is possible to calculate the correction value and set the tool conditions based on the measurement value by using the reference value stored in the storage unit 32 without acquiring the reference value again, when the same processed part is processed at intervals (processing of a repeat product), when the same tool is used for the processing across days, and the like.

In other words, in the bending, the control device 30 causes the read unit 4 to read the reference value associated with the processed part, to which the bending is to be executed, from the association table 8. Then, after the operation of the bending is started, the control device 30 obtains the measurement value of the original position described above, which is acquired by the measurement unit 5, so that the calculation unit 6 calculates the secular change correction value for the pushing amount based on the measurement value and the reference value, so as to set the pushing amount to which the correction value is reflected. Thereafter, the control device 30 calculates the secular change amount for each predetermined trigger condition to correct the pushing amount.

Further, the control device 30 can determine an ON/OFF state of a reset function for the pushing amount of the punch P with respect to the die D, which is set in the ON/OFF set unit 9, for example, based on the input information input via the input unit 37. Since the ON/OFF of the reset function can be set in the control unit 30 by the ON/OFF set unit 9 in this manner, the operator can arbitrarily enable (ON) or disable (OFF) the reset function for the pushing amount regardless of a type of the processed part of the bending or the number of lots, for example.

For example, when the reset function is enabled (ON), a change in the bending angle due to secular change can be automatically corrected (automatic correction). When the reset function is disabled (OFF), the automatic or manual operation of the bending can be performed without setting the trigger condition or the like. When the reset function is ON, the automatic correction can be performed in accordance with various types of bending, such as a bending when the number of lots for the bending is large, a bending when a plurality of processed parts are bent with a small number of lots, a bending when the processed part is bent in a state in which the secular change correction is manually made to the processed part.

It should be noted that when the execution of the resetting in the reset unit 7 is set to OFF during the automatic operation by the ON/OFF set unit 9, the control device 30 may use the secular change correction value calculated most recently to correct the pushing amount or the original position so as to bend the workpiece. By doing so, it is possible to reduce a load of calculation processing of the secular change correction value by the calculation unit 6.

In addition, the control device 30 can determine whether or not a resetting condition for resetting the pushing amount is satisfied. In other words, in the control device 30 of the bending system 1, the pushing amount or the original position is reset by the reset unit 7 when the resetting condition is satisfied after the trigger condition is satisfied, the resetting condition being that the workpiece is being loaded to or unloaded from the bending machine 10 for each of the processed parts.

Therefore, the control device 30 determines that the workpiece is being loaded or unloaded by the automatic robot 20, which is an example of a case in which the resetting condition is satisfied. When the reset function is enabled and the resetting condition is satisfied, the control device 30 acquires a measurement value of the D-axis and calculates the secular change amount from the reference value read based on this (or the previous measurement value) as the correction value. Then, the control device 30 resets the pushing amount of the punch P after correcting the pushing amount by, for example, adding the calculated correction value to the pushing amount.

As a result, for example, it is possible to compare the reference value acquired in advance with the acquired measurement value even from the first bending, thereby making it possible to calculate the secular change amount of the entire mechanical system including the tool, the drive mechanism 16, and the like, which is caused by external factors such as the room temperature. Then, the calculated secular change amount can be used as the correction value for the pushing amount of the punch P with respect to the bending angle (that is, the correction value for the processing conditions).

This makes it possible to continue the automatic operation of the bending until the end of the operation without going through the accuracy confirmation work, while making the correction such as adding or reducing the pushing amount by way of this correction value. Therefore, it is possible to prevent deterioration of processing accuracy, which is caused by the change in the bending angle due to the secular change, without going through the accuracy confirmation work performed by the operator. As a result, it is possible to stabilize quality of the processed part.

Figure 6:
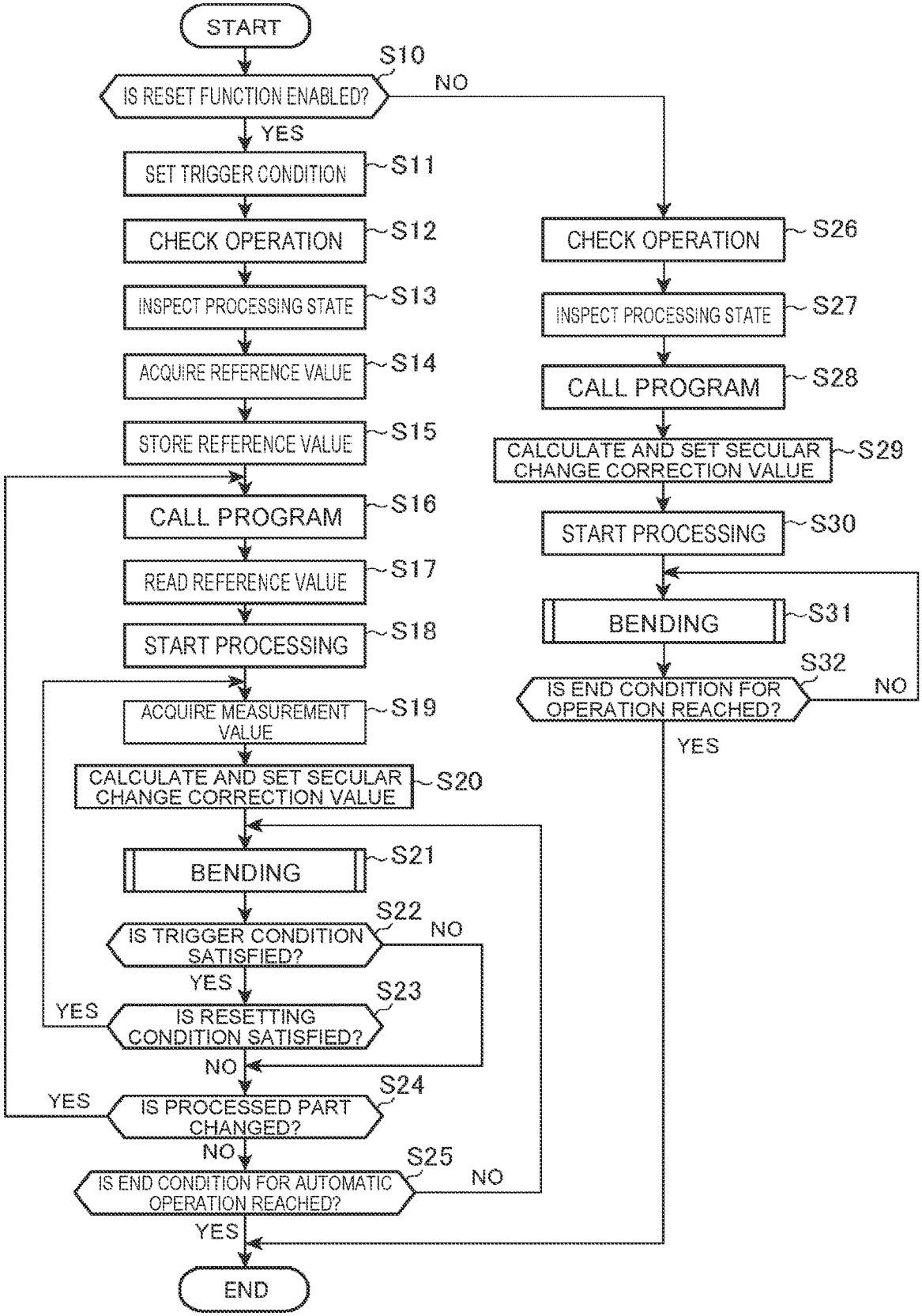
FIG. 6 is a flowchart showing an outline of processing procedures of the bending method executed by the bending system.

FIG. 6 is a flowchart showing an outline of processing procedures of the bending method executed by the bending system. This bending method is executed in the control device 30. Schematically, the bending method according to the present embodiment includes acquiring, by the acquisition unit 2, the reference value (UTA, UTB, or the like) of the original position of the punch P with respect to the die D for each of the processed parts (the product A, the product B, and the like) before the operation of the bending of the workpiece is started by the bending machine 10 including the punch P and the die, storing, by the storage unit 32, each of the acquired reference values (UTA and the like) in association with each of the processed parts (the processed part A and the like), reading, by the read unit 4, the reference value (UTA or the like) associated with the processed part (the processed part A or the like) to which the bending is to be executed, acquiring, by the measurement unit 5, the measurement value (UTA', UTB', or the like) of the original position after the operation of the bending of the workpiece is started, calculating, by the calculating unit 6, the secular change amount from the reference value (UTA or the like) or the previous measurement value based on the acquired measurement values (UTA' or the like) as the secular change correction value (AUTA, AUTB, or the like) of the pushing amount of the punch P with respect to the die D or the original position of the punch P, and resetting, by the reset unit 7, the pushing amount or the original position for each predetermined trigger condition by using the secular change correction value (AUTA or the like) during the automatic operation of the bending of the workpiece. It should be noted that the reference value acquired in the acquiring by the acquisition unit 2 is acquired for each processed part obtained by bending the workpiece, and is obtained when the punch P and the die D are brought into engagement with each other such that a pressure reaches a predetermined pressure. In addition, the bending method further includes performing ON/OFF setting in which the ON/OFF of the execution of the resetting by the reset unit 7 is set by the ON/OFF set unit 9.

Specifically, as shown in FIG. 6, the control device 30 first determines whether or not the reset function for the pushing amount of the tool is enabled (ON), based on the operation input of the operator via the input unit 37 and the input I/F 34 or via the touch panel of the display unit 36, or another setting input from an external PC or the like (hereinafter referred to as the "input information") by activating the bending program read from the storage unit 32 by the arithmetic unit 31, for example (step S10).

In this step S10, the determination of the ON/OFF of the reset function as described above is made based on the input information. For example, in a case such as when it is desired to arbitrarily perform manual bending after the bending of the automatic operation, the operator can arbitrarily disable (OFF) the reset function for the pushing amount, thereby making it possible to skip setting processing of the trigger condition, which will be described later, so as to perform the manual bending.

In step S10, if it is determined that the reset function for the pushing amount is enabled (ON) (YES in step S10), that is, if the resetting is executed, the trigger condition for resetting the pushing amount (for executing the resetting) based on the secular change amount of the entire mechanical system including the tool and the drive mechanism 16 is set based on the input information (step S11).

Here, the trigger condition is, for example, at least one selected from (1) to (5) below. That is, the trigger conditions include:

(1) Room temperature;

(2) Time;

(3) Number of processes;

(4) First bending after the processed part is changed; and (5) Mounting of the tool on the bending machine.

When the trigger condition to be set in step S11 is the room temperature of (1) described above, the condition of the room temperature is set, for example, such as a case in which a room temperature at the start of the automatic operation is set as a reference temperature value and a temperature change is incremented/decremented by +10% from the reference temperature value, and a case in which setting, as the next reference temperature value, is repeated of a temperature value obtained when a temperature rises or falls from the room temperature set as the reference temperature value in an absolute temperature.

Further, when the trigger condition to be set is the time of (2) described above, the condition of the time is set, for example, such as every 30 minutes, every hour, and every two hours from the start of the automatic operation. Further, when the trigger condition to be set is the number of processes of (3) described above, the condition is set, for example, such as the number of lots of the process including every 50 lots, every 100 lots, and the like or the desired number of lots of the process for one processed part from the start of the automatic operation.

Furthermore, when the trigger condition to be set is the first bending after the processed part is changed, which is (4) described above, for example, the first bending of "the processed part A" described above after the automatic operation is started, and the first bending of "the processed part B" when the bending is changed from the bending of "the processed part A" to the bending of "the processed part B" are applicable. Further, when the trigger condition to be set is the mounting on the tool to the bending machine 10, which is (5) described above, the time in which the tool is mounted on the bending machine 10, including the time in which the used tool is changed, is applicable.

It should be noted that when a first tool (for example, the "tool a" described above) mounted on the bending machine 10 is changed to a second tool (for example, the "tool b" described above), the control device 30 determines that the trigger condition of (5) described above is satisfied, and when the second tool (for example, the "tool b") is changed (restored) to the first tool (for example, the "tool a"), the control device 30 does not determine that the trigger condition of (5) described above is satisfied.

In other words, the trigger conditions of (5) include, for example, the case in which it is detected that the same tool has been mounted due to the change when it is necessary to change the tools between the bending processes. As a result, it is possible to skip the calculating and the resetting of the correction value based on the measurement value when the tool is restored, and to continue the bending by using resources such as the correction value associated with the used tool before the change. In the following, for example, a case will be described in which one tool is used for one processed part, the time of (2) is used as the trigger condition to be set, and the pushing amount is reset when 30 minutes have passed since the start of the automatic operation as a trigger.

After the trigger condition is set in step S11, the bending machine 10 and the automatic robot 20 are operated to perform the trial processing of the workpiece for each of the processed parts (in this example, the processed part A and the processed part B). Then, the check operation for the precision imparting is performed (step S12), and a processing state is inspected by measuring the bending angle and various dimensions (step S13). It should be noted that at this time, correction values (processing correction values) relating to the bending angle, the various dimensions, the pushing amount of the punch P, and the like for the preset processing conditions may be calculated and separately stored in the storage unit 32.

Since the processing state is inspected, the reference value of the original position of the punch P with respect to the die D for each of the processed parts (the processed part A and the processed part B in this example) is acquired by the acquisition unit 2 before the start of the automatic operation of the bending (step S14), and each of the acquired reference values is stored in each of the original position reference value columns 8*c* of the association table 8 of the storage unit 32 (step S15).

Next, the arithmetic unit 31 calls a product program corresponding to the processed part, to which the bending is to be executed, from the storage unit 32 (step S16). In addition, the arithmetic unit 31 causes the read unit 4 to read the associated reference value that is stored in the association table 8 (step S17), activates a timer or the like built in the control device 30, and start an operation of product processing (step S18). For example, when the processed part to which the bending is to be executed is "the processed part A" described above, a product program corresponding to the processed part A is called in step S16, and the reference value "UTA" associated with this is read in step 17.

After the processing operation is started, first, during the initial loading, the measurement value of the original position of the punch P is acquired by the measurement unit 5 (step S19), which is stored, if necessary, in the measurement value column 8*d* of the association table 8 of the storage unit 32. Then, the secular change correction value for the secular change amount from the reference value based on the measurement value is calculated by the calculation unit 6. The processing conditions or the tool condition are set by using the calculated secular change correction value, for example, by adding this to an initial pushing amount so as to correct the pushing amount (step S20). It should be noted that the correction of the pushing amount is not limited to the addition of the secular change correction value.

The secular change correction value can be calculated and used for the setting as follows, for example. That is, when the reference value that is read is set to UT0 and the measurement values are set to UT1 to UTn (n is a positive integer), a displacement value ΔUT (a displacement between the measurement value UT1 and the reference value UT0) of the reference position can be calculated as shown in FIG. 3, for example, by comparing the measurement value UT1 with the reference value UT0. When the reference position is set to 0, the displacement value ΔUT can be positive in the direction toward the die D and negative in the direction away from the die D when viewed in terms of a movement stroke of the punch P on the D axis, for example. Then, based on this displacement value ΔUT, the secular change amounts (the secular change correction values) ΔUT1 to ΔUTn from the reference position are calculated by the calculation unit 6, and the pushing amount is corrected, for example, by adding these secular change correction values ΔUT1 to ΔUTn to the initial pushing amount so as to set the processing conditions and the tool condition.

It should be noted that an upper limit value (for example, +0.07 mm) may be set in advance to the secular change correction values ΔUT1 to ΔUTn, and the reset unit 7 may reset the pushing amount or the original position by using the secular change correction value ΔUTn−1 that is calculated last time or the upper limit value when the secular change correction values ΔUT1 to ΔUTn exceed the upper limit value. As a result, even when a secular change occurs that significantly degrades the processing accuracy of the bending, it is possible to adopt an appropriate correction value and continue the automatic operation.

After the processing conditions or the tool condition is set in this manner, bending processing of the workpiece in accordance with the processed part is executed automatically under the set condition (step S21). During the automatic operation of the bending processing, it is determined whether or not the trigger condition is satisfied (whether or not the trigger condition has been reached) based on the time measured by the timer. In other words, it is determined whether or not 30 minutes have passed since the start of the automatic operation (step S22).

If it is determined that 30 minutes have passed since the start of the automatic operation and the trigger condition is satisfied (YES in step S22), it is determined whether or not the resetting condition for resetting the next pushing amount is satisfied, that is, whether or not the workpiece is being loaded or unloaded (step S23). If it is determined that 30 minutes have not passed since the start of the automatic operation and the trigger condition is not satisfied (NO in step S22), the process proceeds to step S24, which will be described later.

In step S23, if it is determined that the resetting condition is satisfied (YES in step S23), the process proceeds to step S19 described above to acquire the next measurement values (UT2 to UTn) of the original position described above and the subsequent processing is repeated. On the other hand, if it is determined that the resetting condition is not satisfied (NO in step S23) and if it is determined that the trigger condition is not satisfied (NO in step S22), it is determined whether or not the processed part is to be changed, for example (step S24).

Then, if it is determined that the processed part is to be changed, that is, "the processed part A" is to be changed to "the processed part B" described above, for example (YES in step S24), the process proceeds to step S16 described above. Then, a product program corresponding to the processed part B is called, the reference value "UTB" associated with this is read in step S17, and the subsequent processing is repeated. It should be noted that when the processed part is to be changed, for example, steps S17 and S19 described above may be omitted and the secular change correction value (AUT) for the processed part before the change may be inherited and used. By doing so, it is possible to eliminate the need for the accuracy confirmation work when the processed part is changed.

On the other hand, if it is determined that the processed part is not to be changed (NO in step S24), it is determined whether or not an end condition for the automatic operation, for example, the preset number of the processing lots of the workpiece (50 lots or the like) or the processing time (3 hours or the like), has been reached (step S25). If it is determined that the end condition has not been reached (NO in step S25), the process proceeds to step S21 described above to continue the automatic operation of the bending processing of the workpiece (step S21). On the other hand, if it is determined that the end condition has been reached (YES in step S21), the automatic operation is ended and the processing of the bending method according to the present flowchart is ended.

If the automatic operation of the bending processing is continued in step S21 described above, it is determined whether or not the trigger condition is satisfied again during the automatic operation, for example, whether or not the predetermined time (30 minutes) has passed since the previous passed time (step S22). Then, if the predetermined time has not passed, it is considered that the trigger condition is not satisfied (NO in step S22), and the process proceeds to step S24. However, if the predetermined time has passed, it is considered that the trigger condition is satisfied (YES in step S22) and it is determined whether or not the resetting condition for the next resetting is satisfied (step S23). Then, if the resetting condition is satisfied (YES in step S23), the process proceeds to step S19 described above and the subsequent processing is repeated.

In this manner, the bending system 1 of the first embodiment acquires and stores the reference value of the original position of the punch P in association with each of the processed parts so as to read the reference value associated with the processed part, to which the bending is actually to be executed, before the start of the automatic operation, and acquires the measurement value of the original position after the start of the automatic operation. Then, after calculating the secular change correction value for the secular change amount from the reference value based on the measurement value, the bending system 1 can use this value to perform the bending under the processing conditions, which include the pushing amount to which the secular change correction value is reflected, even from the first bending.

Further, it is possible to operate the bending automatically by repeating, for example, a plurality of times (for example, n times) at a stage at which the resetting condition is satisfied every time the trigger condition is satisfied, the resetting of the pushing amount, to which the secular change correction value is reflected, until the end condition for the automatic operation is reached. As a result, it is possible to reduce the burden of the accuracy confirmation work performed by the operator without stopping the automatic operation, and at the same time, it is possible to stabilize quality of the processed part.

It should be noted that if it is determined in step S10 described above that the reset function for the pushing amount is not enabled (ON) (disabled (OFF)) (NO in step S10), for example, the check operation (step S26) by the bending machine 10 and the automatic robot 20 is performed to inspect the processing state (step S27) without going through the setting (step S11) of the trigger condition described above.

Then, the product program corresponding to the processed part to which the bending is to be executed is called from the storage unit 32 (step S28), and the secular change correction value such as the secular change correction value set in advance for the processed part, the secular change correction value that has been used in the previous bending for the processed part and inherited without being cleared, or the like is read from the storage unit 32. By using this secular change correction value, the pushing amount is corrected so as to set the processing conditions or the tool condition (step S29).

After that, the operation of the product processing is started (step S30), and the bending processing of the workpiece (step S31) is executed by the automatic operation or the manual operation. Then, it is determined whether or not the end condition for the operation has been reached (step S32), and if the end condition has been not reached (NO in step S32), the bending processing (step S31) is continued. However, if the end condition has been reached (YES in step S32), the operation of the bending is ended, and the processing of the bending method according to the present flowchart is ended.

It should be noted that in the first embodiment described above, the secular change correction values ΔUT1 to ΔUTn of the pushing amount are calculated after the displacement value ΔUT is calculated by comparing the reference value UT0 with each of the measurement values UT1 to UTn. However, the secular change correction values ΔUT1 to ΔUTn of the pushing amount may be calculated after the displacement value ΔUT is calculated by comparing, for example, the acquired measurement value (UTn) with the measurement value (UTn−1) that is acquired before last. Even when the pushing amount is corrected by using the secular change correction values ΔUT1 to ΔUTn calculated in this manner, it is possible to perform the automatic operation of the bending as described above.

Further, in the first embodiment described above, the resetting condition is that the workpiece is being loaded by the automatic robot 20, but this condition may also refer to the workpiece being unloaded by the automatic robot 20, or the workpiece being loaded/unloaded manually. In this manner, if the measurement value is acquired to reset the pushing amount while the workpiece is being loaded/unloaded, the automatic operation of the bending will not be affected. Therefore, during the automatic operation, it is possible to perform the correction so as to eliminate the accuracy confirmation work performed by the operator without stopping the automatic operation.

Furthermore, in the first embodiment described above, the pushing amount of the punch P (the tool) with respect to the die D used for the product processing is measured and acquired, but the present invention is not limited to this. A pushing amount of a tool other than the tool actually used (for example, a punch P with respect to a die D respectively mounted to the upper tool holder 14 and the lower tool holder 15 and not to be used for the bending) may be measured and associated in advance in the storage unit 32 for storage. Even in this manner, it is possible to calculate the secular change correction value similar to the one described above. In other words, as long as the reference value UT0 and the measurement value UTn as described above can be acquired from the same tool, the effect of the present embodiment can be exhibited regardless of whether or not the tool is to be used for the bending.

Modified Example of First Embodiment

In the bending method of the first embodiment described above, the relay operation has been described as an example, in which the different processed parts are continuously bent mainly in the automatic operation of a series of the bending processes. However, this bending method can also be applied to bending when tool change is required between the bending processes. In other words, although illustration is omitted, in a bending method of a modified example, the reference value for each tool is acquired in the acquiring of step S14 described above, and the reference value is associated with each tool and stored in the storing of step S15.

Then, all the reference values associated with the respective tools that are to be used for the 1st to n-th bending, which are specified in the program called in step S16, are read in the reading of step S17. Then, the measurement value in accordance with the currently used tool is acquired after the start of the processing (step S19), and the bending based on the secular change correction value that is calculated based on the acquired measurement value and the reference value of the used tool is performed (step S21).

During the automatic operation of this bending, it is determined whether or not there is tool mounting (including automatic tool mounting) based on the tool change (including automatic tool change by the automatic robot 20) as the trigger condition (step S22). For example, if there is the automatic tool mounting by the automatic robot 20 (YES in step S22) and the resetting condition is satisfied (YES in step S23), the measurement value based on the used tool that is mounted is acquired except when the tool is restored (step S19). The secular change correction value is calculated based on this measurement value and the reference value of the used tool that has been read, and the bending is performed until the processed part is changed or the end condition for the operation is satisfied (step S21).

In this manner, in the bending method of the modified example, even if the bending is performed in such a manner that the used tool is changed in the bending of one processed part, it is possible to stabilize quality of the processed part while reducing the burden of the accuracy confirmation work performed by the operator. It should be noted that the reference value associated with each tool may be stored in association with each tool set when, for example, the tool set consisting of a plurality of tools is changed as a unit of the tool change.

Second Embodiment

Figure 7:
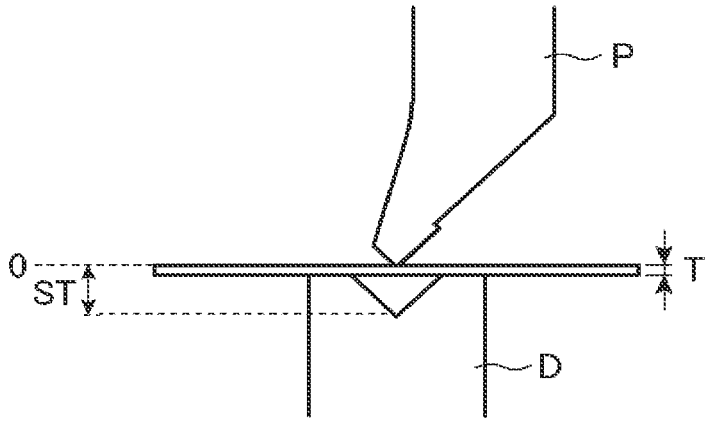
FIG. 7 is an explanatory diagram showing an outline of a typical tool used for a bending machine of a bending system according to a second embodiment of the present invention.

FIG. 7 is an explanatory diagram showing an outline of a typical tool used for a bending machine of a bending system according to a second embodiment of the present invention. It should be noted that in the following descriptions, the same or corresponding components as those of the first embodiment and its modified example are designated by the same reference signs, and thus duplicated descriptions will be omitted.

A bending method according to the second embodiment is different from the bending method according to the first embodiment in which the pushing amount is reset based on the reference position, in that the original position of the punch P is reset based on the D-axis position when the workpiece is interposed between the punch P and the die D, that is, when the workpiece is interposed between the tools, and thus the pushing amount is not changed.

In other words, the reference value and the measurement value are acquired based on the D-axis position when the workpiece is interposed between the punch P and the die D. In this case, in the second embodiment, as shown in FIG. 7, the original position of the punch P is set as a position (a reference position (0 mm)) when the distal end of the punch P is brought into contact with a surface of the workpiece in a state in which the workpiece having a thickness T is placed on the die D, for example. A pushing amount ST represents a distance from this reference position to a groove bottom portion (a lower end portion) of a V-groove portion of the die D.

Then, in the bending method of the second embodiment, for example, the original position of the punch P is measured to calculate the secular change correction value after the automatic operation of the bending is started, and thereafter, the original position of the punch P is reset by using the secular change correction value for each predetermined trigger condition. In this manner, the automatic operation of the bending is continued until the end of the operation while the original position of the punch P is being reset without changing the pushing amount, for example. In the bending method of the second embodiment, it is also possible to correct the change in the bending angle due to the secular change without stopping the operation, and at the same time, it is possible to stabilize quality of the processed part while reducing the accuracy confirmation work performed by the operator.

Third Embodiment

Figure 8:
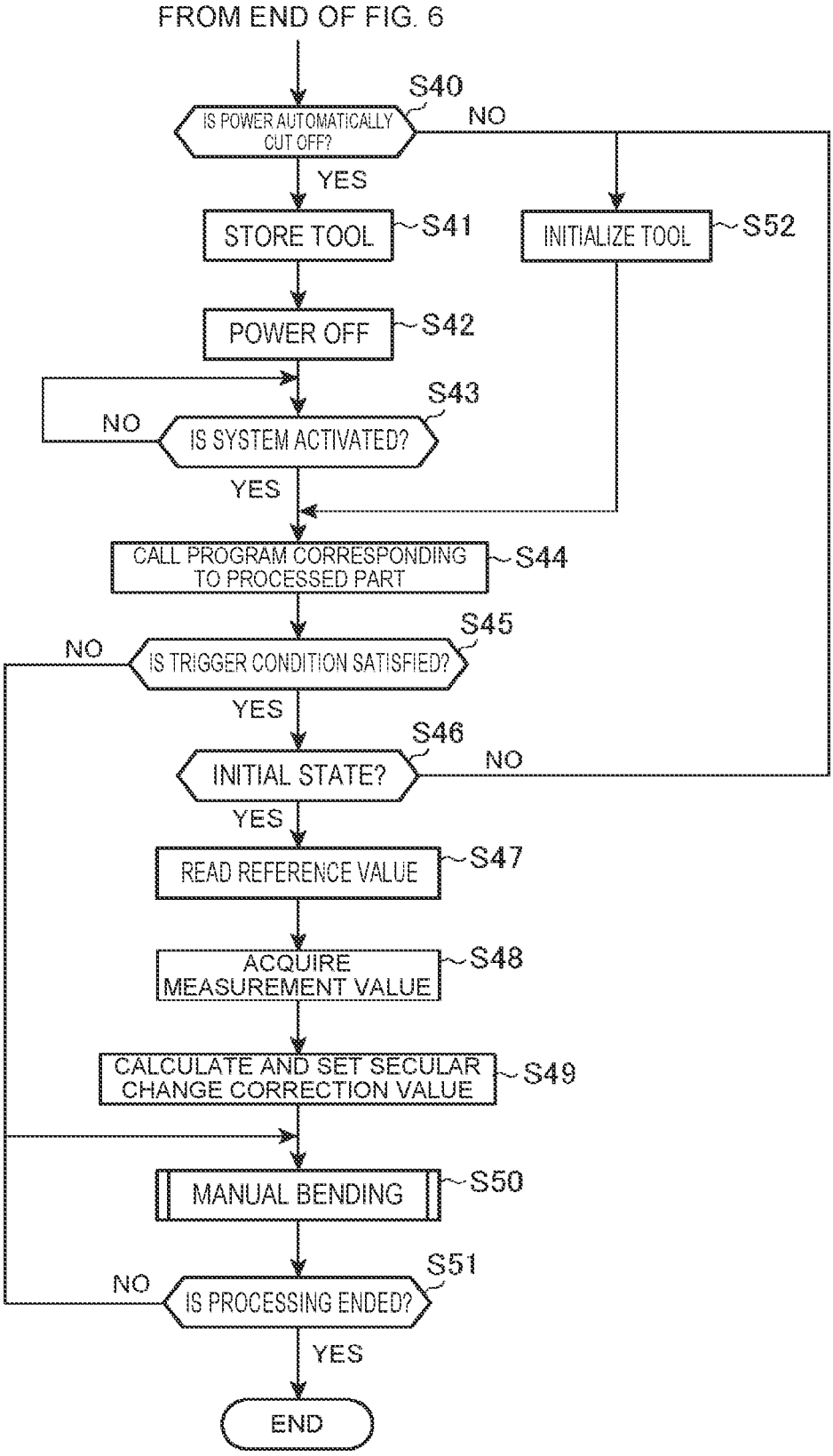
FIG. 8 is a flowchart showing an outline of processing procedures of a bending method according to a third embodiment of the present invention.

FIG. 8 is a flowchart showing an overview of processing procedures of a bending method according to a third embodiment of the present invention. The third embodiment assumes a case in which the secular change correction value is used when the bending is manually performed. Here, the description will be made assuming that the processing continues from the processing of the bending method according to the flowchart of FIG. 6, but the processing is not limited to this.

As shown in FIG. 8, after the processing of FIG. 6 is ended, the arithmetic unit 31 of the control device 30 determines whether or not the power to the bending machine 10 is automatically cut off (step S40). If it is determined that the power is automatically cut off (YES in step S40), the control device 30 causes the automatic robot 20 to temporarily store the used tool used for the bending in a tool stocker or the like (step S41) so that the power is cut off (OFF) (step S42).

Then, the control device 30 waits until the bending system 1 is activated by power-on or the like (NO in step S43), and when the bending system 1 is activated (YES in step S43), a program corresponding to a processed part, for which the bending is desired by the manual bending, is called by the operation input of the operator via the input unit 37 and the input I/F 34, for example (step S44). For example, it is determined whether or not there is the automatic tool mounting to the bending machine 10 by the automatic robot 20 as, for example, the trigger condition (step S45).

If it is determined that there is the tool mounting and the trigger condition is satisfied (YES in step S45), it is determined whether or not the mounted tool is in an initial state (step S46). If it is determined that the mounted tool is not in the initial state (NO in step S46), the process proceeds to step S52, which will be described later, and the tool is initialized.

If it is determined that the tool is in the initial state (YES in step S46), the reference value associated with the processed part that is manually bent or the reference value associated with the mounted tool is read from the association table 8 of the storage unit 32 (step S47), and the measurement value of the original position described above is acquired (step S48). Then, the secular change correction value based on the measurement value and the reference value is calculated so as to set the processing conditions and the like (step S49), and the bending of the workpiece by the manual bending is performed (step S50).

Finally, it is determined whether or not the end condition for the manual bending has been reached (step S51), and if it is determined that the end condition has not been reached (NO in step S51), the bending processing by the manual bending (step S50) is continued. However, if it is determined that the end condition has been reached (YES in step S51), the operation of the bending by the manual bending is ended, and the processing of the bending method according to the present flowchart is ended.

It should be noted that if it is determined in step S40 described above that the power is not automatically cut off (NO in step S40), the control device 30 executes tool initialization processing including the automatic tool change by the automatic robot 20 and tool storage by which the used tool is temporarily stored in the tool stocker or the like (step S52). Then, the process proceeds to step S44 described above, and the subsequent processing is repeated.

In this manner, even when the bending by the manual bending is performed, it is possible to perform the bending without requiring the accuracy confirmation work performed by the operator. It is also possible to reduce the burden of the accuracy confirmation work and stabilize quality of the processed part in the same manner as the effects of the first and second embodiments described above. It should be noted that steps S40 to S43, S46, and S52 described above can be skipped, for example, so as to configure the bending method by the manual bending in a simpler manner.

Further Embodiment

Figure 9:
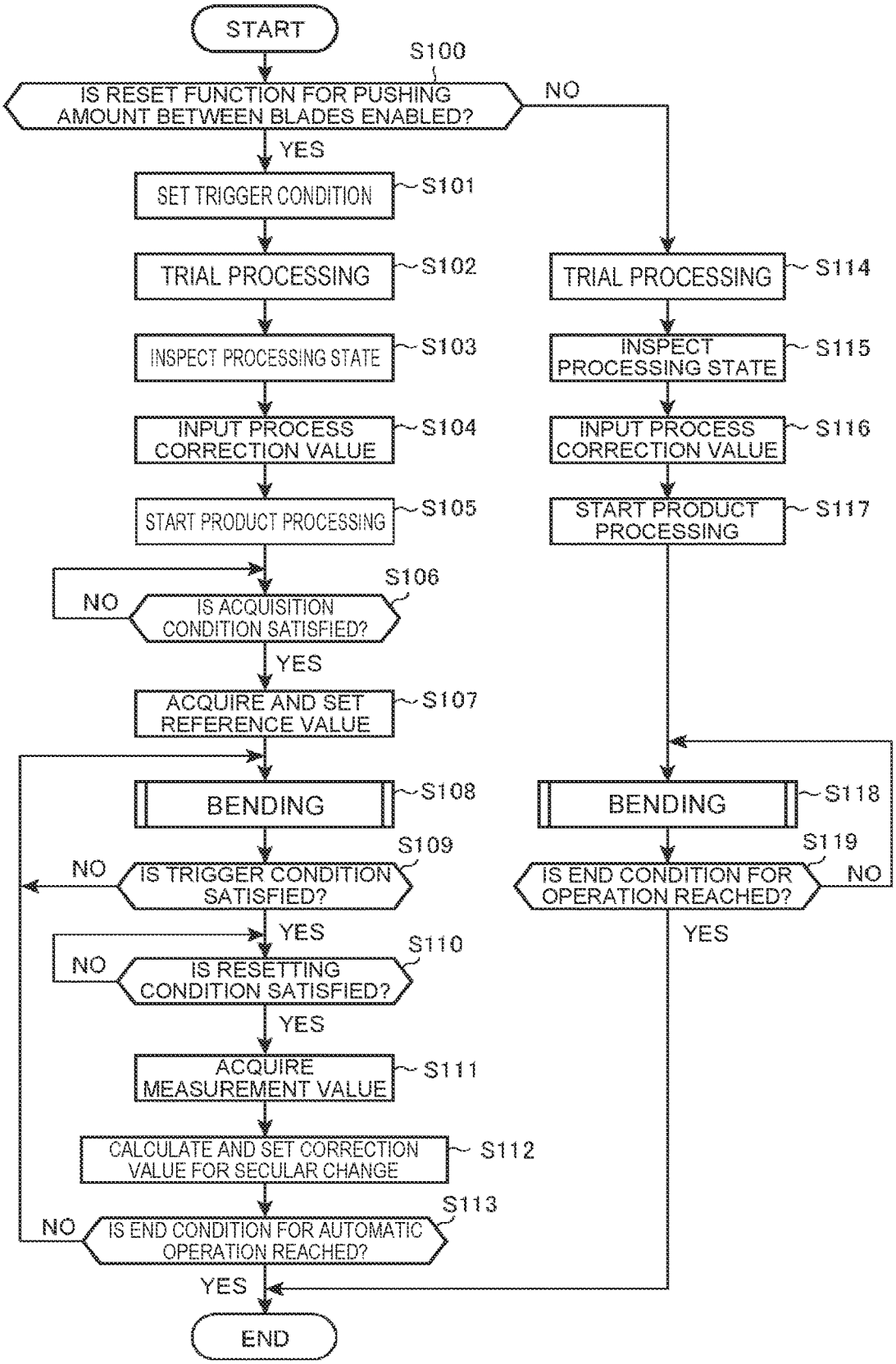
FIG. 9 is a flowchart showing an outline of processing procedures of a bending method according to a further embodiment of the present invention.

FIG. 9 is a flowchart showing an overview of processing procedures of a bending method according to a further embodiment of the present invention.

In the bending method according to the further embodiment, it is possible to correct the change in the bending angle due to the secular change of the bending system 1 that is automatically operated without stopping the operation. At the same time, it is also possible to improve productivity and quality.

The control device 30 of the present embodiment can determine the ON/OFF of the reset function for the pushing amount of the punch P with respect to the die D, for example, based on the input information input via the input unit 37. For example, when the number of lots for the bending is large, the operator can arbitrarily enable (ON) the reset function for the pushing amount so that the change in the bending angle due to the secular change can be automatically corrected. Further, when the number of lots for the bending is small, the operator can arbitrarily disable (OFF) the reset function for the pushing amount so that the automatic operation can be performed without setting the trigger condition and the like.

Further, the control device 30 can determine whether or not an acquisition condition for setting an initial reference position and the resetting condition for resetting the pushing amount are satisfied. The control device 30 determines that the workpiece is being loaded or unloaded by the automatic robot 20, which is an example of a case in which the acquisition condition and the resetting condition are satisfied. When the reset function is enabled, the control device 30 waits until the acquisition condition and the resetting condition are satisfied. When the acquisition condition is satisfied, the control device 30 acquires the value of the D-axis as the reference position. When the resetting condition is satisfied, the control device 30 calculates the secular change amount as the correction value, and resets the pushing amount of the punch P after correcting the pushing amount by, for example, adding the correction value to the pushing amount.

Further, the control device 30 executes the resetting in which the pushing amount described above is reset for each predetermined trigger condition during the automatic operation of the bending of the workpiece by the bending machine 10. More specifically, when the automatic operation of the bending is started, the control device 30 acquires the initial reference position to set the pushing amount, and thereafter, calculates the secular change amount of the reference position for each predetermined trigger condition to correct the pushing amount.

As a result, for example, by comparing the reference position acquired later with the reference position initially acquired, it is possible to calculate the secular change amount of the entire mechanical system including the tool, the drive mechanism 16, and the like due to the external factors such as the room temperature is calculated. Then, by using the calculated secular change amount as the correction value for the pushing amount of the punch P related to the bending angle (that is, the correction value for the processing condition), it is possible to make the corrections, such as adding or subtracting the correction value to or from the pushing amount so as to continue the automatic operation of the bending until the end of the operation. Therefore, the change in the bending angle due to the secular change can be corrected without stopping the operation of the bending. As a result, productivity and quality of the bent processed part can be improved.

As shown in FIG. 9, the control device 30 first determines whether or not the reset function for the pushing amount of the tool is enabled (ON) by the operation input of the operator (user) as described above or the input information such as the setting input as described above by activating the bending program that the arithmetic unit 31 has read from the storage unit 32 (step S100).

In other words, in this step S100, the ON/OFF of the reset function is determined based on the input information. For example, as described above, in the case such as when the number of lots for the bending is small, the operator can arbitrarily disable the reset function for the pushing amount so that the automatic operation can be performed while skipping setting processing of the trigger condition that will be described later.

In this step S100, if it is determined that the reset function for the pushing amount is enabled (ON) (Yes in step S100), that is, when the resetting is executed, the trigger condition for resetting the pushing amount based on the input information (for executing the resetting) is set (step S101). As the trigger condition, for example, at least one of the time, the room temperature, and the number of processes is set.

Here, when the trigger condition to be set is the time, the condition of the time is set, for example, such as every hour or every two hours from the start of the automatic operation. Further, when the trigger condition to be set is the room temperature, the condition of the room temperature is set, for example, such as the case in which the room temperature at the start of the automatic operation is used as the reference value and the temperature change is incremented/decremented by +10% from the reference value, or a case in which the setting, as the next reference value, is repeated of the value obtained when the temperature rises or falls from the room temperature in the absolute temperature. Furthermore, when the trigger condition to be set is the number of processes, the condition of the number of lots of the process is set, for example, such as every 50 lots or every 100 lots from the start of the automatic operation.

In addition, for example, when it is necessary to change the tools between the processes, the case or the like may be set as the trigger condition in which it is detected that the same tool has been installed due to the change. Hereinafter, it is assumed that the room temperature is used as the trigger condition to be set, and the pushing amount is reset using the case as a trigger in which a predetermined temperature change is incremented/decremented from the room temperature at the start of the automatic operation.

After the trigger condition is set in this manner, the bending machine 10 and the automatic robot 20 are operated to perform the trial processing (the check operation) of the workpiece (step S102), and the processing state is inspected by measuring the bending angle and various dimensions (Step S103). After that, the correction values (the processing correction values), which are related to the bending angle, the various dimensions, the pushing amount of the punch P, and the like with respect to the processing conditions that have been set, are calculated. Then, the processing correction values are set by being input based on the input information (step S104), and the temperature is measured by the room temperature sensor 38 so as to start the operation of the product processing (step S105).

When the processing operation is started, it is first determined whether or not the acquisition condition of the reference value for setting the initial pushing amount is satisfied (step S106). In the present embodiment, this acquisition condition means that the workpiece is being loaded by the automatic robot 20. Therefore, the control device 30 waits until the acquisition condition is satisfied (for example, until the workpiece is being loaded for the first time) (No in step S106). When the acquisition condition is satisfied (when the workpiece is being loaded) (Yes in step S106), the control device 30 acquires a value of the initial reference position (the reference value UT0) to set the tool condition (step S107).

It should be noted that if this reference value UT0 that is acquired is stored, for example, in the storage unit 32, the tool condition can be set by using the reference value UT0 when the same tool is used to perform the product processing across days. As a result, it is not necessary to acquire the reference value UT0 again. Then, the bending processing of the workpiece (step S108) is automatically executed under the processing conditions including the tool condition that has been set.

During the automatic operation of the bending processing, it is determined whether or not the trigger condition is satisfied (the trigger condition has been reached) based on the room temperature measured by the room temperature sensor 38, that is, whether or not the predetermined temperature change has been incremented/decremented from the room temperature at the start of the automatic operation (step S109). If it is determined that the predetermined temperature change has not been incremented/decremented from the room temperature at the start of the automatic operation and thus the trigger condition is not satisfied (No in step S109), the bending processing in step S108 is continued.

On the other hand, if it is determined that the predetermined temperature change has been incremented/decremented from the room temperature at the start of the automatic operation and thus the trigger condition is satisfied (Yes in step S109), it is determined whether or not the resetting condition for resetting the next pushing amount is satisfied (step S110). In other words, as described above, the control device 30 waits until the resetting condition is satisfied (No in step S110). When the resetting condition is satisfied (Yes in step S110), the control device 30 acquires a value of the next reference position (the measurement value UT1) (step S111).

When the measurement value UT1 acquired in this manner is compared with the reference value UT0 initially acquired, the displacement value ΔUT (the displacement between the measurement value UT1 and the reference value UT0) of the reference position can be calculated as shown in FIG. 3. When the reference position is set to 0, the displacement value ΔUT can be positive in the direction toward the die D and negative in the direction away from the die D when viewed in terms of the movement stroke of the punch P on the D-axis, for example. Then, the correction value (the secular change amount) ΔUT1 of the initial secular change from the reference position is calculated based on the displacement value ΔUT, and the pushing amount is corrected, for example, by adding the correction value ΔUT1 to the initial pushing amount to set the tool condition (step S112). It should be noted that the correction of the pushing amount is not limited to the addition of the correction value ΔUT1.

After setting the tool condition, it is determined whether or not the end condition for the automatic operation, for example, a preset number of processing lots of the workpiece (200 lots or the like) has been reached (step S113). If it is determined that the end condition has not been reached (No in step S113), the automatic operation of the bending processing of the workpiece (step S108) is continued based on the processing conditions including the tool condition set in step S112. On the other hand, if it is determined that the end condition has been reached (Yes in step S113), the automatic operation is ended and the processing of the bending method according to the present embodiment is ended.

If the automatic operation of the bending processing is continued in step S108 described above, it is determined whether or not the trigger condition is satisfied during the automatic operation, for example, whether or not the predetermined temperature change has been incremented/decremented from the previously incremented/decremented room temperature (step S109). If the predetermined temperature change has not been incremented/decremented, the bending processing is continued as it is because it is considered that the trigger condition is not satisfied (No in step S109). However, if there is the predetermined temperature change, it is considered that the trigger condition is satisfied (Yes in step S109) and it is determined whether or not the resetting condition for the next resetting is satisfied (step S110).

Also at this point, as described above, the control device 30 waits until the resetting condition is satisfied (No in step S110). When the resetting condition is satisfied (Yes in step S110), the control device 30 acquires a value of the next reference position (the measurement value UT2) (step S111). Then, the measurement value UT2 is compared with the initial reference value UT0 to calculate a displacement value ΔUT (a displacement between the measurement value UT2 and the reference value UT0) of the reference position, and a correction value (secular change amount) ΔUT2 of a second secular change from the reference position is calculated. The pushing amount is corrected by this correction value ΔUT2, for example, by adding the correction value ΔUT2 to the initial pushing amount as described above to set the tool condition (step S112). Thereafter, the next determination processing (step S113) is executed, and the subsequent processing is repeated.

In this manner, the bending system 1 of the further embodiment can repeat the acquisition of the value of the reference position a plurality of times (for example, n times) until the end condition for the automatic operation is reached, for example, at a stage at which the resetting condition is satisfied every time the trigger condition is satisfied. As a result, it is possible to calculate the displacement value ΔUT associated with the secular change of the tool and the mechanical system by respectively comparing the reference value UT0 of the reference position initially acquired with the measurement values UT1 to UTn of the reference position acquired for the first to nth acquisitions, and then to calculate the correction values ΔUT1 to ΔUTn of the first to nth secular changes. Then, after correcting the pushing amount by using the correction values ΔUT1 to ΔUTn, for example, by adding the respective correction values ΔUT1 to ΔUTn to the pushing amount, the automatic operation of the bending can be continued. This makes it possible not only to correct the change in the bending angle due to the secular change without stopping the automatic operation, but also to improve productivity and quality.

It should be noted that in step S100 described above, if it is determined that the reset function for the pushing amount is not enabled (disabled (OFF)) (No in step S100), the trial processing by the bending machine 10 and the automatic robot 20 is performed (step S114), the processing state is inspected (step S115), and the processing correction value is calculated without going through the setting of the trigger condition (step S101) as described above. Then, the processing correction value is set by being input based on the input information (step S116), the operation of the product processing is started (step S117), and the bending processing of the workpiece (step S118) is executed by the automatic operation or the manual operation.

After that, it is determined whether or not the end condition for the operation has been reached (step S119). If the end condition has not been reached (No in step S119), the bending processing (step S118) is continued. However, if the end condition is reached (Yes in step S119), the operation of the bending is ended and the processing of the bending method according to the present embodiment is ended.

It should be noted that in the further embodiment, the correction values ΔUT1 to ΔUTn of the pushing amount may be calculated after the displacement value ΔUT is calculated by comparing the acquired measurement value with the previously acquired measurement value (or the reference value) every time the value of the reference position is acquired. Even when the pushing amount is corrected by using the correction values ΔUT1 to ΔUTn calculated in this manner, it is possible to continue the automatic operation of the bending as described above.

Further, the acquisition condition or the resetting condition for resetting may be that the workpiece is being loaded by the automatic robot 20. In this manner, if the acquisition of the reference position and the resetting of the pushing amount are performed while the workpiece is being loaded/unloaded, the automatic operation of the bending will not be affected. As a result, the correction can be performed without stopping the automatic operation in a more reliable manner.

Although some embodiments of the present invention have been described above, these embodiments are presented as examples and are not intended to limit the scope of the invention. These novel embodiments can be implemented in various other embodiments, and various omissions, replacements, and changes can be made without departing from the gist of the invention. These embodiments and modifications thereof are included in the scope and the gist of the invention, and are also included in the scope of the invention described in the claim and the equivalent scope thereof.

For example, in the further embodiment described above, the pushing amount is corrected by obtaining the correction value based on the reference position by using the tool including the punch P and the die D, but the correction is not limited to this. Additionally, the correction value may be obtained by calculating the result after calculating an amount of extension (change) of the support unit 13 itself when no load is applied, or an amount of strain or the like due to an influence of a load based on the extension or the like of the support unit 13 itself when a predetermined load is applied, or the like, which is measured by a strain gauge provided on the support unit 13 of the bending machine 10.

It should be noted that the bending method described in each of the embodiments described above can be achieved, for example, by executing a bending program prepared in advance on a computer such as a personal computer or a workstation. This bending program is recorded in a computer-readable recording medium such as an HDD, an SSD, a CD-ROM, a DVD, a memory card, or the like and is executed by being read from the recording medium by the computer. The bending program may also be a transmission medium that can be distributed via a network such as the Internet.

REFERENCE SIGNS LIST

1 Bending system
2 Acquisition unit
4 Read unit

5 Measurement unit
6 Calculation unit
7 Reset unit
8 Association table
9 ON/OFF set unit
10 Bending machine
11 Upper table
12 Lower table
13 Support unit
14 Upper tool holder
15 Lower tool holder
16 Drive mechanism
17 Position detection sensor
18 Bending load detection sensor
20 Automatic robot
30 Control device
32 Storage unit

The invention claimed is:

1. A bending method comprising executing the steps of:

acquiring, with a control device configured to control a bending machine to acquire, a reference value of an original position of a punch with respect to a die for each processed part before an operation of bending of a workpiece by athe bending machine including the punch and the die is started;

storing each of the acquired reference values in association with each of the processed parts;

reading the reference value associated with the processed part to which the bending is to be executed;

acquiring a measurement value of the original position after the operation of the bending of the workpiece is started;

calculating, based on the acquired measurement value, a secular change amount from the reference value or a previous measurement value as a secular change correction value for a pushing amount of the punch with respect to the die or the original position of the punch;

resetting, for each predetermined trigger condition, the pushing amount or the original position by using the secular change correction value during an automatic operation of the bending of the workpiece;

storing, with the control device, the secular change correction value in association with each of the processed parts; and repeating the steps after the step of storing each of the acquired reference values in association with each of the processed parts, with the control device, when the processed part to which the bending is to be executed is changed.

2. The bending method according to claim 1, wherein the reference values include a reference value associated with the tool used for the bending of the processed part.

3. The bending method according to claim 1, wherein the trigger condition is at least one selected from (1) to (5) below:

(1) Room temperature;
(2) Time;
(3) Number of processes;
(4) First bending after the processed part is changed; and
(5) Mounting of the tool on the bending machine.

4. The bending method according to claim 3, wherein the control device determines that the trigger condition of (5) is satisfied when a first tool mounted on the bending machine is changed to a second tool, and the control device does not determine that the trigger condition of (5) is satisfied when the second tool is changed to the first tool.

5. The bending method according to claim 1, wherein the pushing amount or the original position is reset when the resetting condition is satisfied after the triggering condition is satisfied, and the resetting condition is that the workpiece is being loaded to or unloaded from the bending machine for each of the processed parts.

6. The bending method according to claim 1, wherein the control device executes ON/OFF setting in which ON/OFF of an execution of the resetting is set.

7. The bending method according to claim 1, wherein the reference value and the measurement value are acquired based on a D-axis position when a predetermined load is applied to the punch and the die.

8. The bending method according to claim 1, wherein the reference value and the measurement value are acquired based on a D-axis position when the workpiece is interposed between the punch and the die.

9. A bending method executing:

acquiring in which a control device that controls a bending machine acquires a reference value of an original position of a punch with respect to a die for each processed part before an operation of bending of a workpiece by the bending machine including the punch and the die is started;

storing each of the acquired reference values in association with each of the processed parts;

reading the reference value associated with the processed part to which the bending is to be executed;

acquiring a measurement value of the original position after the operation of the bending of the workpiece is started;

calculating, based on the acquired measurement value, a secular change amount from the reference value or a previous measurement value as a secular change correction value for a pushing amount of the punch with respect to the die or the original position of the punch;

resetting, for each predetermined trigger condition, the pushing amount or the original position by using the secular change correction value during an automatic operation of the bending of the workpiece; and ON/OFF setting in which ON/OFF of an execution of the resetting is set, wherein when the execution of the resetting is set to OFF during the automatic operation, the secular change correction value calculated most recently is used to correct the pushing amount or the original position so as to bend the workpiece.

10. A bending method executing:

acquiring in which a control device that controls a bending machine acquires a reference value of an original position of a punch with respect to a die for each processed part before an operation of bending of a workpiece by the bending machine including the punch and the die is started;

storing each of the acquired reference values in association with each of the processed parts;

reading the reference value associated with the processed part to which the bending is to be executed;

acquiring a measurement value of the original position after the operation of the bending of the workpiece is started;

calculating, based on the acquired measurement value, a secular change amount from the reference value or a previous measurement value as a secular change correction value for a pushing amount of the punch with respect to the die or the original position of the punch; and resetting, for each predetermined trigger condition, the pushing amount or the original position by using the secular change correction value during an automatic operation of the bending of the workpiece, wherein an upper limit value is set in advance to the secular change correction value, and the control device resets the pushing amount or the original position by using the secular change correction value that is calculated last time or the upper limit value when the secular change correction value, which is calculated in the calculating, exceeds the upper limit value.

11. A bending system comprising:

a bending machine including a punch, a die, and a position detection sensor; and a control device configured to control the bending machine to perform bending, wherein the control device includes:

a CPU that is capable of executing various types of processing;

an acquisition unit configured to execute processing of acquiring a reference value of an original position of the punch with respect to the die for each processed part from the position detection sensor before an operation of the bending of a workpiece by the bending machine is started;

a storage unit including a storage medium that is capable of executing processing of storing each of the acquired reference values in association with each of the processed parts;

a read unit configured to execute processing of reading the reference value associated with the processed part to which the bending is to be executed from the storage medium;

a measurement unit configured to execute processing of acquiring a measurement value of the original position from the position detection sensor after the operation of the bending of the workpiece is started;

a calculation unit configured to execute processing of calculating, based on the acquired measurement value, a secular change amount from the reference value or a previous measurement value as a secular change correction value for a pushing amount of the punch with respect to the die or the original position of the punch; and a reset unit configured to execute processing of resetting, for each predetermined trigger condition, the pushing amount or the original position by using the secular change correction value during an automatic operation of the bending of the workpiece, wherein:

the storage unit stores the secular change correction value in association with each of the processed parts, and processing after the storing is repeated when the processed part is changed.

12. The bending system according to claim 11, wherein the reference values include a reference value associated with the tool used for the bending of the processed part.

13. The bending system according to claim 11, wherein the trigger condition is at least one selected from (1) to (5) below:

(1) Room temperature;

(2) Time;

(3) Number of processes;

(4) First bending after the processed part is changed; and (5) Mounting of the tool on the bending machine.

14. The bending system according to claim 13, wherein the control device determines that the trigger condition of (5) is satisfied when a first tool mounted on the bending machine is changed to a second tool, and does not determine that the trigger condition of (5) is satisfied when the second tool is changed to the first tool.

15. The bending system according to claim 11, wherein the pushing amount or the original position is reset when the resetting condition is satisfied after the triggering condition is satisfied, and the resetting condition is that the workpiece is being loaded to or unloaded from the bending machine for each of the processed parts.

16. The bending system according to claim 11, wherein the control device comprises an ON/OFF set unit configured to execute processing of setting ON/OFF of an execution of the resetting in the reset unit.

17. The bending system according to claim 11, wherein the reference value and the measurement value are acquired based on a D-axis position when a predetermined load is applied to the punch and the die.

18. The bending system according to claim 11, wherein the reference value and the measurement value are acquired based on a D-axis position when the workpiece is interposed between the punch and the die.

19. A bending system comprising:

a bending machine including a punch, a die, and a position detection sensor; and a control device configured to control the bending machine to perform bending, wherein the control device includes:

a CPU that is capable of executing various types of processing;

an acquisition unit configured to execute processing of acquiring a reference value of an original position of the punch with respect to the die for each processed part from the position detection sensor before an operation of the bending of a workpiece by the bending machine is started;

a storage unit including a storage medium that is capable of executing processing of storing each of the acquired reference values in association with each of the processed parts;

a read unit configured to execute processing of reading the reference value associated with the processed part to which the bending is to be executed from the storage medium;

a measurement unit configured to execute processing of acquiring a measurement value of the original position from the position detection sensor after the operation of the bending of the workpiece is started;

a calculation unit configured to execute processing of calculating, based on the acquired measurement value, a secular change amount from the reference value or a previous measurement value as a secular change correction value for a pushing amount of the punch with respect to the die or the original position of the punch;

a reset unit configured to execute processing of resetting, for each predetermined trigger condition, the pushing amount or the original position by using the secular change correction value during an automatic operation of the bending of the workpiece and an ON/OFF set unit configured to execute processing of setting ON/OFF of an execution of the resetting in the reset unit, wherein when the execution of the resetting in the reset unit is set to OFF by the ON/OFF set unit during the automatic operation, the secular change correction value calculated most recently is used to correct the pushing amount or the original position so as to bend the workpiece.

20. A bending system comprising:

a bending machine including a punch, a die, and a position detection sensor; and a control device configured to control the bending machine to perform bending, wherein the control device includes:

a CPU that is capable of executing various types of processing;

an acquisition unit configured to execute processing of acquiring a reference value of an original position of the punch with respect to the die for each processed part from the position detection sensor before an operation of the bending of a workpiece by the bending machine is started;

a storage unit including a storage medium that is capable of executing processing of storing each of the acquired reference values in association with each of the processed parts;

a read unit configured to execute processing of reading the reference value associated with the processed part to which the bending is to be executed from the storage medium;

a measurement unit configured to execute processing of acquiring a measurement value of the original position from the position detection sensor after the operation of the bending of the workpiece is started;

a calculation unit configured to execute processing of calculating, based on the acquired measurement value, a secular change amount from the reference value or a previous measurement value as a secular change correction value for a pushing amount of the punch with respect to the die or the original position of the punch; and a reset unit configured to execute processing of resetting, for each predetermined trigger condition, the pushing amount or the original position by using the secular change correction value during an automatic operation of the bending of the workpiece, wherein an upper limit value is set in advance to the secular change correction value, and the reset unit resets the pushing amount or the original position by using the secular change correction value that is calculated last time or the upper limit value when the secular change correction value, which is calculated in the calculating, exceeds the upper limit value.

* * * * *